US007320605B2

(12) United States Patent
Chang et al.

(10) Patent No.: US 7,320,605 B2
(45) Date of Patent: Jan. 22, 2008

(54) BOARD-TO-BOARD CONNECTOR WITH IMPROVED TERMINAL CONTACTS

(75) Inventors: Wei-Sun Chang, Taipei (TW); Pei-Chang Chao, Taipei (TW); Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/407,572

(22) Filed: Apr. 19, 2006

(65) Prior Publication Data

US 2006/0264074 A1 Nov. 23, 2006

(30) Foreign Application Priority Data

Apr. 21, 2005 (TW) ..... 94206263 U

(51) Int. Cl.
*H01R 12/00* (2006.01)

(52) U.S. Cl. ..... 439/74; 439/660; 439/295; 439/284

(58) Field of Classification Search ..... 439/74–75, 439/660, 295, 284
See application file for complete search history.

(56) References Cited

U.S. PATENT DOCUMENTS 7,037,117 B2 * 5/2006 Goto ..... 439/74
7,070,424 B2 * 7/2006 Obikane et al. ..... 439/74
7,118,388 B2 * 10/2006 Midorikawa et al. ..... 439/74

* cited by examiner

*Primary Examiner*—Truc Nguyen
(74) *Attorney, Agent, or Firm*—Charles S. Cohen

(57) ABSTRACT

An electrical connector is provided for use in a board-to-board electrical connector assembly and includes a dielectric housing for mounting on a first printed circuit board and having a receptacle for receiving a plug portion of a mating connector mounted on a second printed circuit board. A plurality of conductive terminals are mounted on the housing, and each terminal includes a contact arm extending into the receptacle. The contact arm has first and second contact portions projecting into the receptacle at different angles for engaging a terminal of the mating connector.

18 Claims, 7 Drawing Sheets

FIG.3
(PRIOR ART)
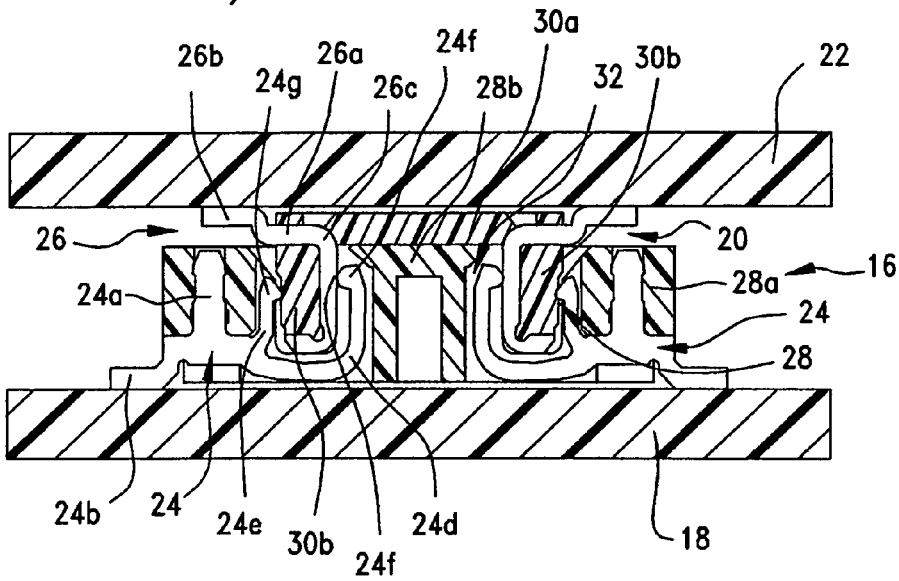
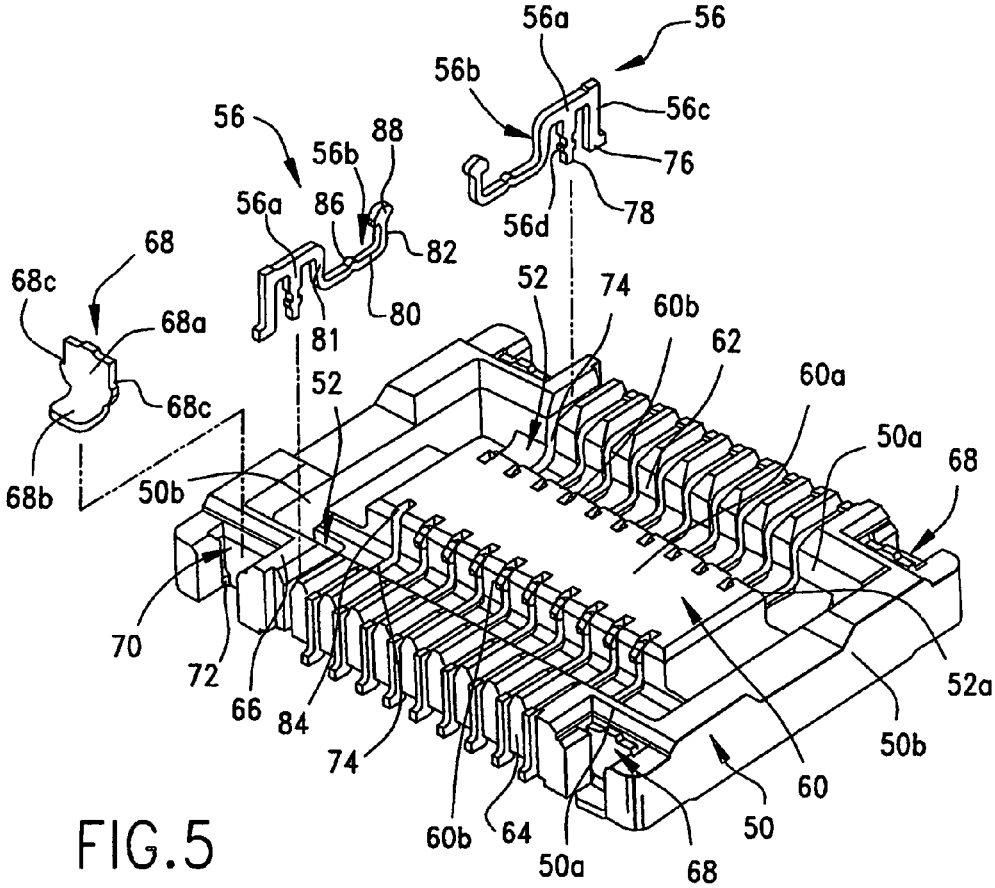
FIG.5

BOARD-TO-BOARD CONNECTOR WITH IMPROVED TERMINAL CONTACTS

FIELD OF THE INVENTION

This invention generally relates to the art of electrical connectors and, particularly, to a board-to-board electrical connector assembly having terminals with improved contacts.

BACKGROUND OF THE INVENTION

Miniature board-to-board electrical connector assemblies are known in the art. Conventionally, a first or receptacle connector is mounted on a first printed circuit board, and a plug or second connector is mounted on a second printed circuit board. The plug connector is inserted into the receptacle connector, with the two printed circuit boards in generally parallel relationship.

FIGS. 1-3 show such an assembly as is known in the prior art. Specifically, a board-to-board electrical connector assembly, generally designated 14, includes a first connector, generally designated 16, mounted on a first printed circuit board 18, and a second connector, generally designated 20, mounted on a second printed circuit board 22. First connector 16 mounts a plurality of conductive terminals, generally designated 24, and second connector 20 mounts a plurality of conductive terminals, generally designated 26. The terminals are in two parallel rows.

More particularly, first connector 16 includes a dielectric housing, generally designated 28, which is generally rectangular and has opposite, elongated side walls 28*a*, an elongated central platform 28*b* and an insertion groove, generally designated 28*c*, between the side walls and the central platform. Each terminal 24 includes a mounting post 24*a* fixed within a respective one of the side walls 28*a* of the housing, along with a tail portion 24*b* connected, as by soldering, to an appropriate circuit trace on the first printed circuit board 18. Each terminal includes a generally U-shaped contact portion defined by a base section 24*c* and to side sections 24*d* and 24*e* joined to the base section. Side section 24*b* has a contact portion 24*f* at the distal end thereof, and side section 24*e* has a retaining portion 24*g* at the distal end thereof. The U-shaped contact sections are disposed at the bottom of insertion groove 28*c* of housing 28.

Second connector 20 includes a dielectric housing, generally designated 30, which includes a bottom wall 30*a* and pair of side walls 30*b* defining a receiving groove, generally designated 30*c*, between the side walls. Terminals 26 are mounted on the side walls to define two rows of terminals for mating with the two rows of terminals 24 of the first connector 16. Each terminal 26 includes a body portion 26*a* fixed within a respective one of the side walls 30*b* of the housing, along with a tail portion 26*b* for connection, as by soldering, to an appropriate circuit trace on the second printed circuit board 22. Each terminal includes a contact portion 26*c* at the inside surface of the respective side wall 30*b*.

When connectors 16 and 20 are mated, side walls 30*b* of housing 30 (along with contact portions 26*c* of terminals 26) of connector 20 move into insertion groove 28*c* of housing 28 of connector 16. Simultaneously, platform 28*b* of housing 28 of the first connector moves into receiving groove 30*c* of housing 30 of connector 20. During mating, contact portions 24*f* of terminals 24 of the first connector engage contact portions 26*c* of terminals 26 of the second connector.

Retaining portions 24*g* of terminals 24 rigidly abut against the outside surfaces of side walls 30*b* of housing 30 of the second connector, while contact portions 24*f* are free to flex within contact grooves 32 at opposite sides of platform 28*b* of housing 28 of the first connector.

In high frequency transmissions, the magnitude of contact impedance affects the transmission rate. With each terminal 24 having only one contact portion 24*f* engaging contact portion 26*c* of the respective terminal 26, there is only one contact point between each pair of mating terminals. Therefore, the contact impedance cannot be reduced effectively, resulting in a limited transmission rate. Consequently, the applicability of the board-to-board connector assembly 14 is reduced. The present invention is directed to solving these problems by providing contacts which effectively reduce the contact impedance in order to promote the transmission rate of electrical connector 16.

SUMMARY OF THE INVENTION

An object, therefore, of the invention is to provide a new and improved electrical connector assembly of the character described.

In the exemplary embodiment of the invention, an electrical connector is disclosed for use in a board-to-board electrical connector assembly. The connector includes a dielectric housing for mounting on a first printed circuit board and having a receptacle for receiving a plug portion of a mating connector mounted on a second printed circuit board. A plurality of conductive terminals are mounted on the housing, and each terminal includes a contact arm extending into the receptacle. The contact arm has first and second contact portions projecting into the receptacle at different angles for engaging a terminal of the mating connector.

According to one aspect of the invention, the receptacle has an opening for receiving the plug portion of the mating connector in an insertion direction. The first contact portion projects into the receptacle toward the opening generally parallel to the insertion direction. The second contact portion projects into the receptacle generally perpendicular to the insertion direction.

According to another aspect of the invention, the contact arm includes a base section at a bottom of the receptacle, with the first contact portion projecting from the base section into the receptacle. The contact arm includes a flexible free section at an end of the base section. The second contact portion projects from a distal end of the free section into the receptacle.

According to a further aspect of the invention, the contact arm of the terminal is generally U-shaped, with a base section and a pair of side sections. The first and second contact portions are disposed on the base section and one of the side sections.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIGS. 1-3 are views of a prior art board-to-board electrical connector assembly as described in the Background, above, with the connectors of the assembly unmated in FIGS. 1 and 2 and mated in FIG. 3;

FIG. 5 is a perspective view looking at the mating end of a first connector according to the invention, with two of the terminals and one of the fixing members removed from the housing to facilitate the illustration;

DETAILED DESCRIPTION OF THE PREFERRED EMBODIMENT

Figure 1:
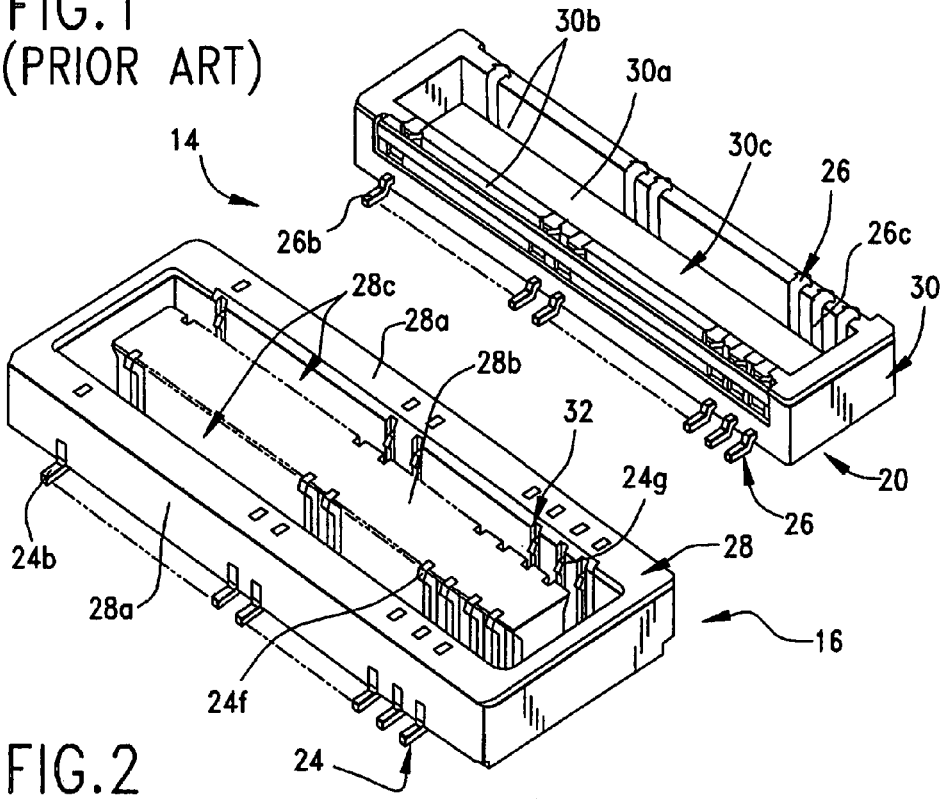
FIG.1 (PRIOR ART)
Figure 2:
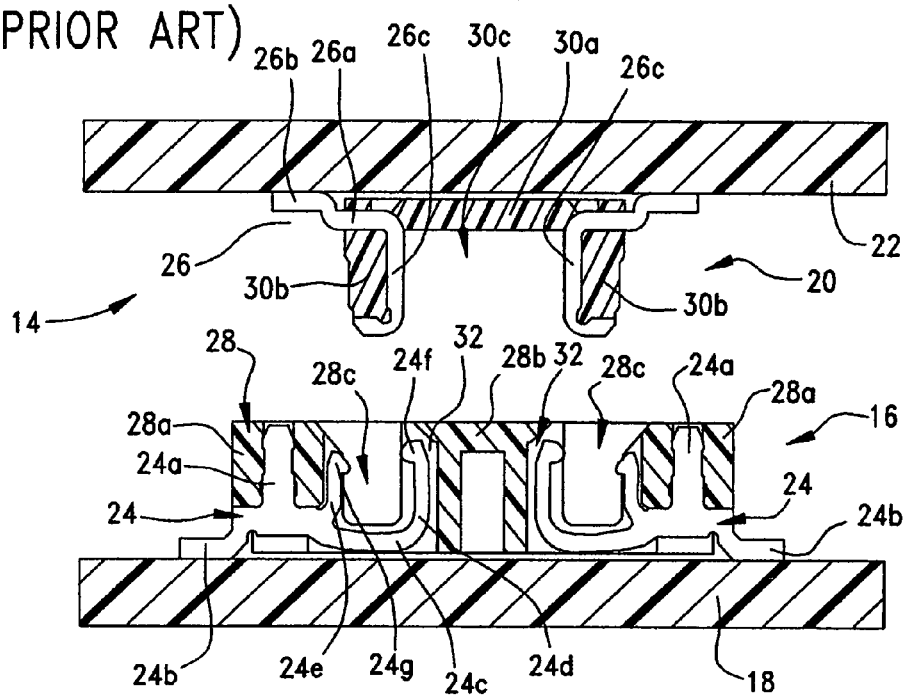
FIG.2 (PRIOR ART)
Figure 4:
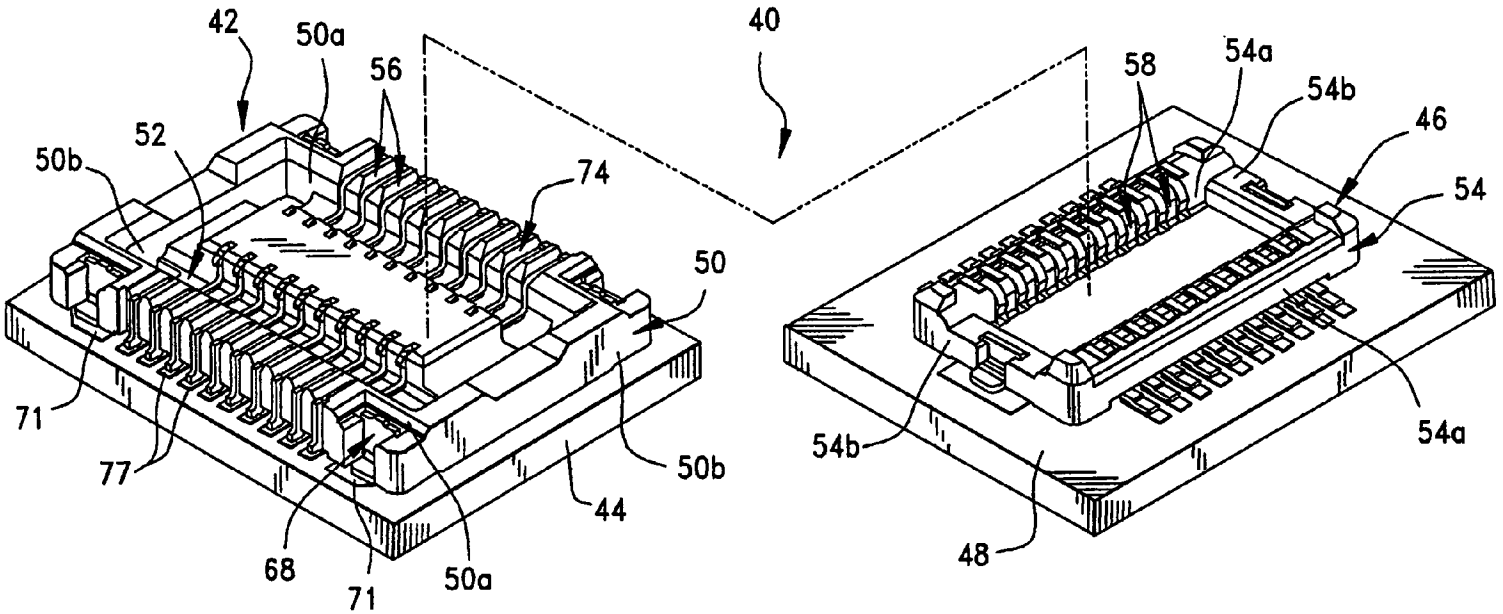
FIG. 4 is a perspective view of a pair of connectors of a board-to-board electrical connector assembly according to the invention.

Referring to the drawings in greater detail, and first to FIG. 4, the invention is embodied in a board-to-board electrical connector assembly, generally designated 40, which includes a first electrical connector, generally designated 42, mounted on a first printed circuit board 44, and a second connector, generally designated 46, mounted on a second printed circuit board 48. The first connector includes a dielectric housing, generally designated 50, which includes a pair of opposite side walls 50*a* and a pair of opposite end walls 50*b* which combine to define a generally rectangular receptacle, generally designated 52. The receptacle has an insertion opening 52*a*. Second connector 46 includes a dielectric housing, generally designated 54, which includes a pair of opposite side walls 54*a* and a pair of opposite end walls 54*b* which combine to define a rectangular structure which is insertable into rectangular receptacle 52 of first connector 42. The housings of the connectors may be molded of plastic material. Side walls 50*a* of the housing of the first connector mount a plurality of conductive terminals, generally designated 56, and side walls 54*a* of the housing of the second connector mount a plurality of conductive terminals, generally designated 58. Therefore, both connectors have two rows of interengaging or mating terminals.

Figure 6:
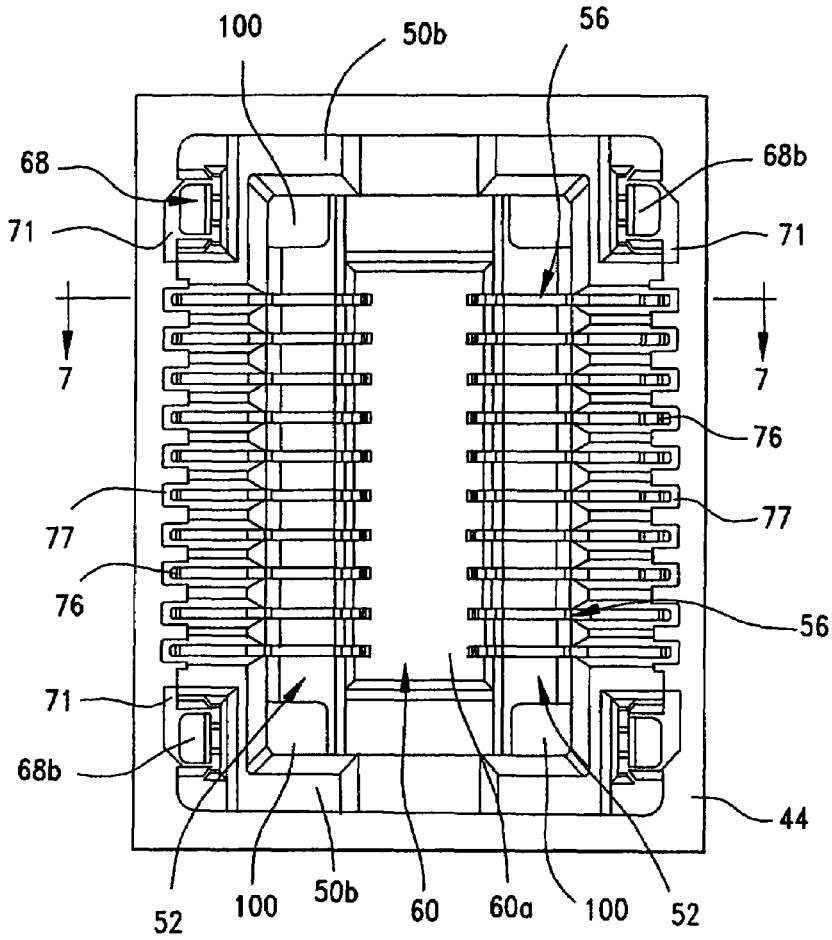
FIG. 6 is a top plan view of the connector shown in FIG. 5.
Figure 7:
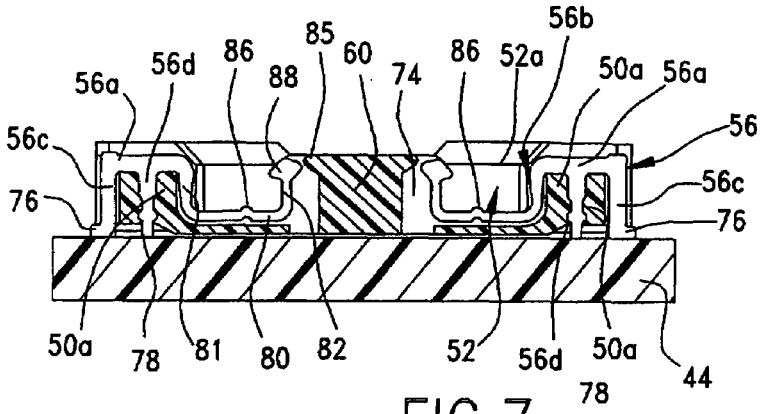
FIG. 7 is a vertical section taken generally along line 7-7 in FIG. 6.

More particularly, referring to FIGS. 5-7, rectangular receptacle 52 in housing 50 of first connector 42 surrounds an elongated or rectangular platform, generally designated 60, which has a top surface 60*a* and opposite side surfaces 60*b*. Each side wall 50*a* has an inside surface 62, an outside surface 64 and a top surface 66.

Housing 50 of first connector 42 is fixed to the first printed circuit board 44 by four fixing members, generally designated 68, at the outside four corners of the housing. The fixing members are inserted downwardly into grooves 70 formed in the housing. Each fixing member is generally L-shaped and includes a vertical body portion 68*a* which is positioned in a respective groove 70, along with a horizontal tail portion 68*b* which is fixed, as by soldering, to an appropriate mounting pad 71 on printed circuit board 44. Teeth 68*c* project outwardly from opposite side edges of body portion 68*a* and skive into the plastic material of housing 50 within the respective groove 70 to secure the fixing member within the groove. Positioning blocks 72 (FIG. 5) are provided at opposite sides of the groove to abut teeth 60*c* and properly position the fixing member within the groove.

As best seen in FIGS. 5 and 7, terminals 56 are mounted within a plurality of terminal-receiving grooves 74 in housing 50. Each terminal includes an elongated body portion 56*a*. A generally U-shaped contact arm, generally designated 56*b*, extends inwardly into receptacle 52 from an inner end of the body portion. A first support arm 56*c* projects from the opposite end of the body portion toward printed circuit board 44 and includes a foot 76 for connection, as by soldering, to a circuit trace 77 on the printed circuit board. A second support arm 56*d* extends from body portion 56*a* toward the printed circuit board and terminates in a foot 78 for connection, as by soldering, to a circuit trace on the printed circuit board. It can be seen in FIG. 7 that the first support arm 56*c* extends from the body portion outside the housing, while second support arm 56*d* extends from the body portion through the housing. In essence, the two, generally parallel support arms capture a portion of the housing therebetween and rigidly fix the terminals to the housing notwithstanding any pulling forces on the contact portions of the terminals. Support arms 56*d* may have teeth at opposite edges thereof to skive into the plastic material of the housing to further lock the terminals thereto.

The U-shaped contact arm 56*b* of each terminal 56 includes a base section 80, a retaining section 81 and a flexible free section 82. Retaining section 81 is disposed within a respective groove 74 at the inside surface 62 of a respective one of the side walls 50*a* of housing 50. Base section 80 is located at the bottom of receptacle 52. Free section 82 can flex within a respective groove 84 (FIG. 5) in a side surface 60*b* of platform 60 beneath a locating block 85 (FIG. 7) of the platform. A first contact portion 86 projects into receptacle 52 in a direction toward the opening of the receptacle. This is generally parallel to the mating direction of the terminals. A second contact portion 88 projects into the receptacle generally perpendicular to the mating direction of the connectors. Therefore, the two contact portions 86 and 88 project into the receptacle at different angles for engaging a respective terminal 58 (FIG. 4) of the second connector 46, as described hereinafter.

Figure 8:
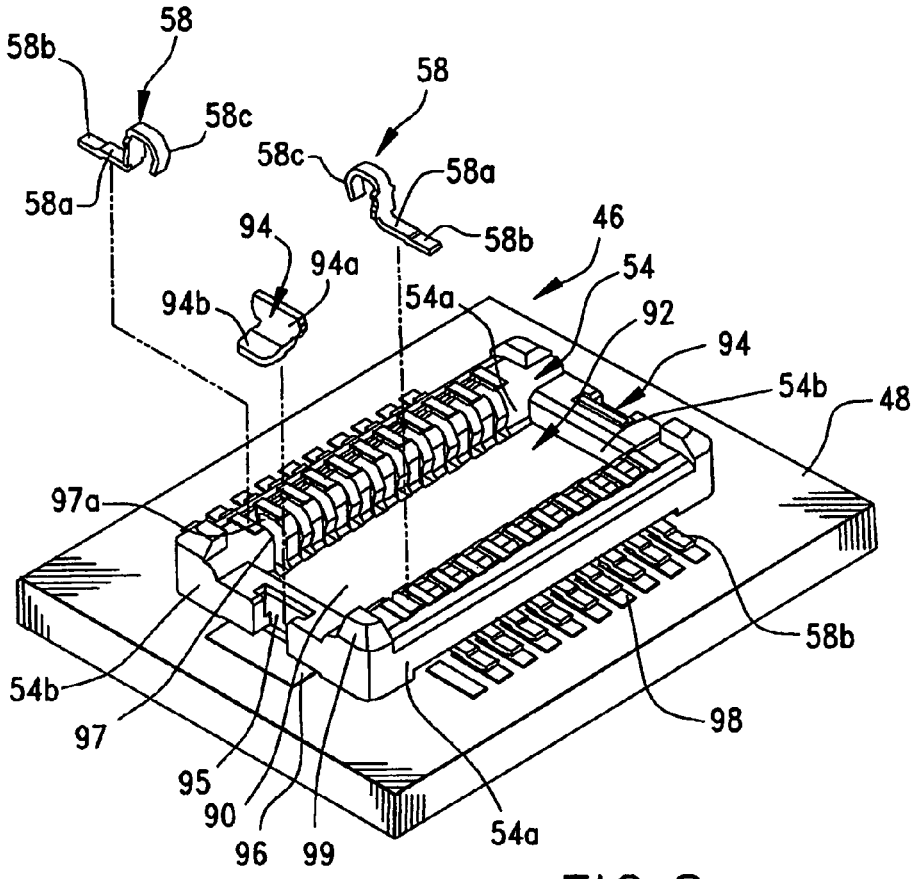
FIG. 8 is a view similar to that of FIG. 5, but of the second connector of the assembly.
Figure 10:
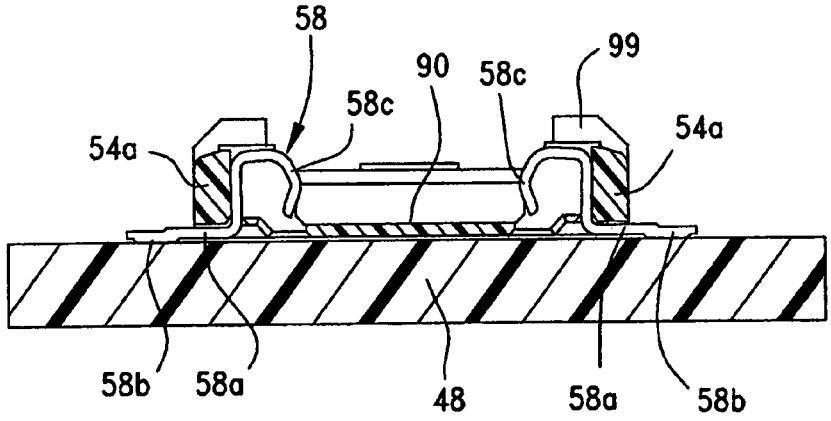
FIG. 10 is a vertical section taken generally along line 10-10 in FIG. 9.
Figure 9:
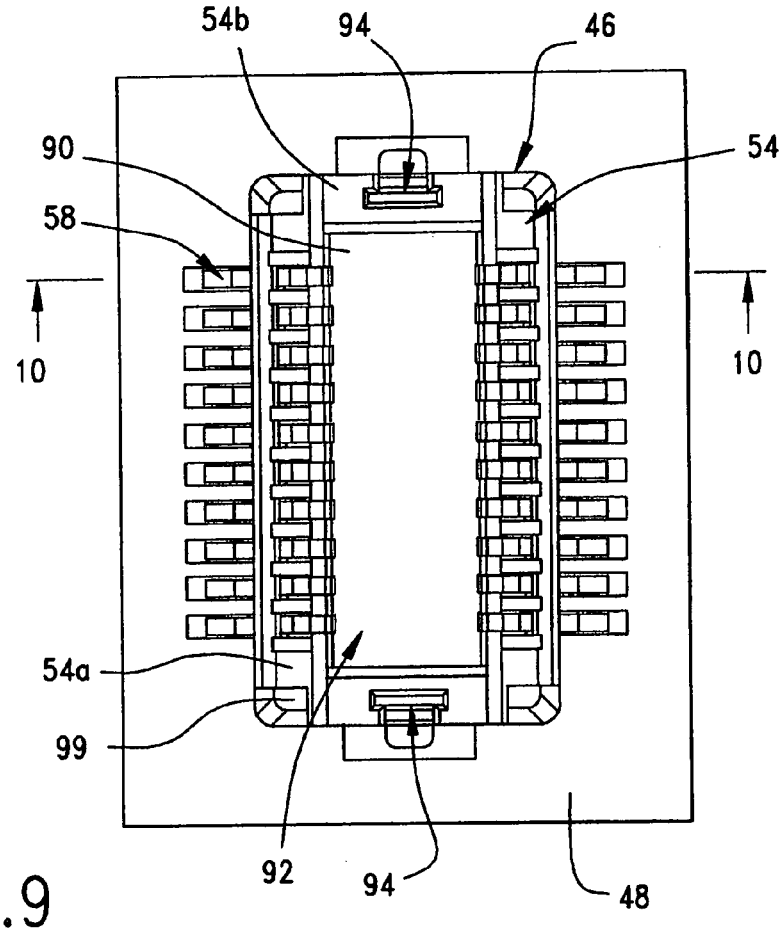
FIG. 9 is a top plan view of the connector shown in FIG. 8.

Referring to FIGS. 8-10, housing 54 of second connector 46 includes a bottom wall 90 which combines with side walls 54*a* and end walls 54*b* to define a cavity, generally designated 92, which receives platform 60 of the first connector when the connectors are mated. A pair of L-shaped fixing members, generally designated 94, are positionable within a pair of slots 95 at opposite ends of the housing. The fixing members have body portions 94*a* for rigidly securing within the slots, along with tail portions 94*b* for securement, as by soldering, to a pair of mounting pads 96 on printed circuit board 42.

Terminals 58 are mounted with a plurality of terminal-receiving grooves, generally designated 97, in side walls 54*a* of the housing of second connector 46, through openings 50*a* at the tops of the grooves. Each terminal 58 has a base section 58*a*. An offset tail portion 58*b* projects from one end of the base section for connection, as by soldering, to circuit traces 98 on the second printed circuit board 48. A U-shaped contact portion 58*c* projects from the opposite end of base section 58*a* and is located at the inside of the respective side wall 54*a* of the housing, as seen clearly in FIG. 10. Therefore, as stated above, there are two rows of terminals 58 (i.e., contact portions 58*c*) running along housing 54 for engaging the two rows of terminals 56 of first connector 42.

Figure 11:
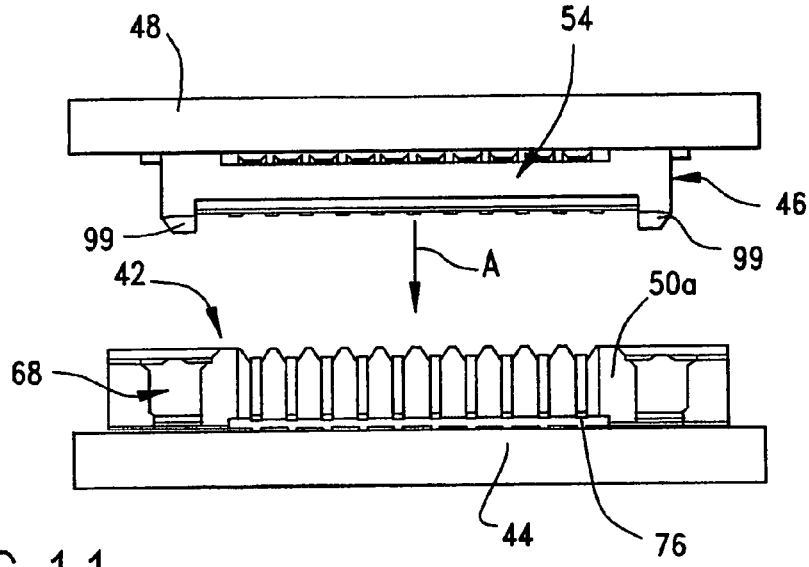
FIG. 11 is a side elevational view of the two connectors about to be mated.
Figure 12:
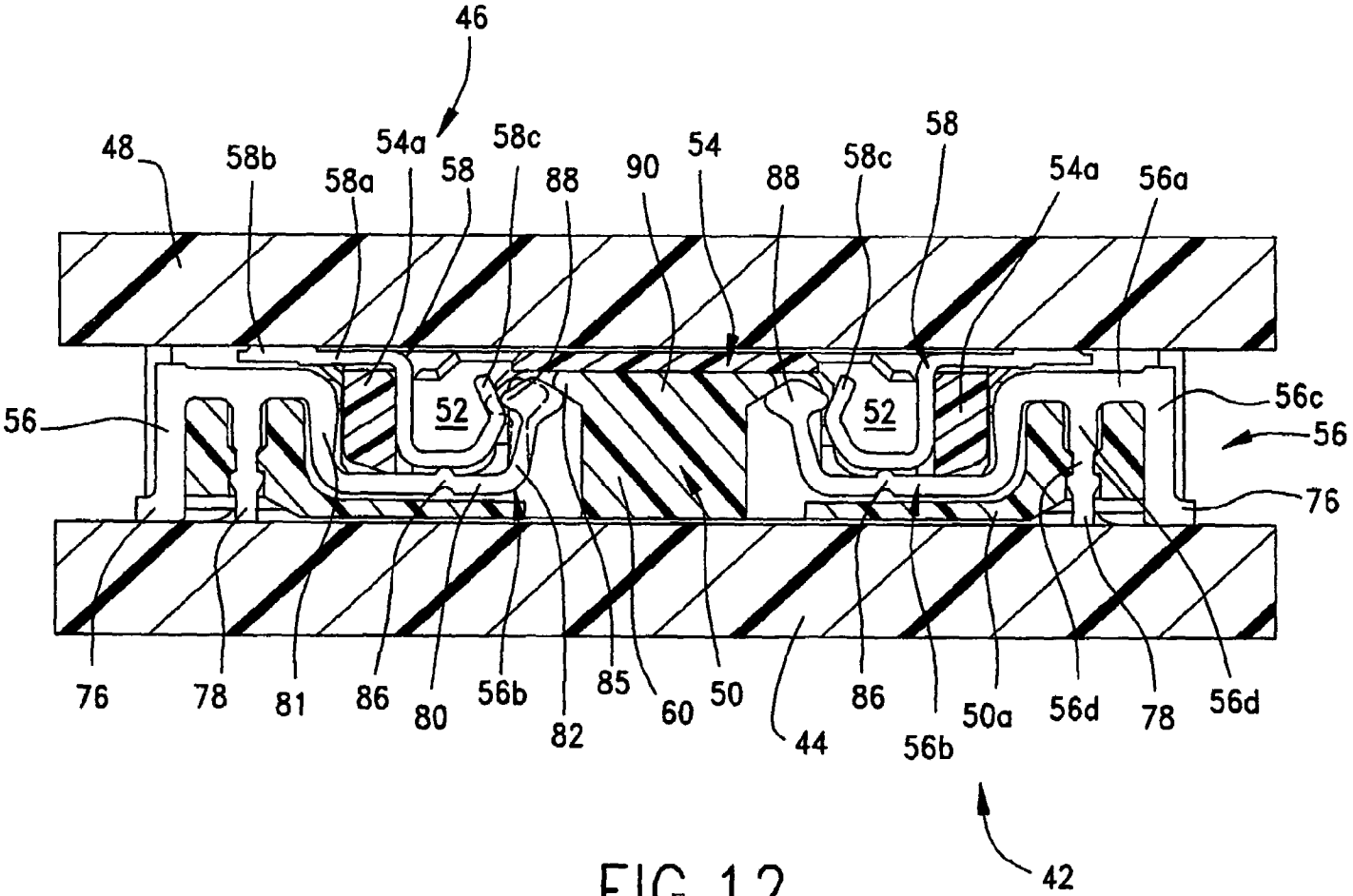
FIG. 12 is a sectional view through the connectors in mated condition.

FIG. 11 shows second connector 46 mounted on printed circuit 48 and about to be mated with first connector 42 mounted on printed circuit board 44, in an insertion or mating direction indicated by arrow "A". During mating, chamfered guide posts 99 at the four corners of housing 54 of the second connector guide the second connector into mated condition with the first connector, and into holes 100 (FIG. 6) in housing 50 in connector 42. FIG. 12 shows the two connectors fully mated. It can be seen that first contact portions 86 of terminals 56 of first connector 42 engage contact portions 58*c* of terminals 58 of second connector 46 in a direction generally parallel to the insertion or mating direction of the connectors. On the other hand, the second contact portions 88 of terminals 56 engage contact portions 58*c* of terminals 58 in a direction generally perpendicular to the insertion or mating direction of the terminals. Therefore, the two different contact portions project into engagement at different angles as the connectors are mated. The dotted lines for free section 82 of the U-shaped contact arm 56*b* of the left-hand terminal 56 in FIG. 12, show the flexing of the free section during mating. In essence each side wall 54*a* of second connector 46 comprises a plug portion for insertion into receptacle 52 of first connector 42.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a board-to-board electrical connector assembly, an electrical connector comprising:

a dielectric housing for mounting on a first printed circuit board and including a receptacle for receiving a plug portion of a mating connector mounted on a second printed circuit board; and a plurality of conductive terminals mounted on the housing and each terminal including a contact arm extending into the receptacle, the contact arm having first and second contact portions projecting into the receptacle at different angles, said first projecting contact portion being for engaging a terminal of the mating connector, and said second projecting contact portion being for engaging the mating connector terminal at a location different from the engaging location of said first projecting contact portion.

2. The electrical connector of claim 1 wherein said receptacle has an opening for receiving the plug portion of the mating connector in an insertion direction, said first contact portion projecting into the receptacle toward the opening generally parallel to the insertion direction.

3. The electrical connector of claim 2 wherein said second contact portion projects into the receptacle generally perpendicular to the insertion direction.

4. The electrical connector of claim 1 wherein said receptacle has an opening for receiving the plug portion of the mating connector in an insertion direction, said second contact portion projecting into the receptacle generally perpendicular to the insertion direction.

5. The electrical connector of claim 1 wherein said contact arm includes a base section at a bottom of the receptacle, with said first contact portion projecting from the base section into the receptacle.

6. The electrical connector of claim 5 wherein said contact arm includes a flexible free section at an end of the base section, with said second contact portion projecting from a distal end of the free section into the receptacle.

7. The electrical connector of claim 1 wherein said contact arm includes a flexible section, with said second contact portion projecting from a distal end of the flexible section into the receptacle.

8. The electrical connector of claim 1 wherein said receptacle has an opening through which the plug portion of the mating connector is inserted into the receptacle, said contact arm of the terminal being generally U-shaped with a base section and a pair of side sections, said first and second contact portions being disposed on the base section and one of the side sections.

9. In a board-to-board electrical connector assembly, an electrical connector comprising:

a dielectric housing for mounting on a first printed circuit board and including a receptacle for receiving a plug portion of a mating connector mounted on a second printed circuit board, the receptacle having an opening for receiving a terminal of the plug portion of the mating connector in an insertion direction; and a plurality of conductive terminals mounted on the housing and each terminal including a contact arm having a base section at a bottom of the receptacle, a first contact portion projecting from the base section into the receptacle toward the opening generally parallel to the insertion direction, a flexible free section projecting from an end of the base section and including a second contact portion projecting from a distal end of the free section into the receptacle generally perpendicular to the insertion direction, each of said first projecting contract portion and said second projecting contact portion being for engaging the mating connector terminal at different locations.

10. The electrical connector of claim 9 wherein said contact arm is generally U-shaped to define said base section, along with a pair of side sections, one of the side sections defining said flexible free section.

11. A board-to-board electrical connector assembly, comprising:

a mating connector mounted on a printed circuit board and including a plug portion having a mating terminal thereon;

a first connector including a dielectric housing for mounting on another printed circuit board and including a receptacle for receiving the plug portion of the mating connector; and a plurality of conductive terminals mounted on the housing of the first connector and each terminal including a contact arm extending into the receptacle, the contact arm having first and second contact portions projecting into the receptacle at different angles, each first and second contact portion being for engaging the terminal of the mating connector.

12. The electrical connector of claim 11 wherein said receptacle has an opening for receiving the plug portion of the mating connector in an insertion direction, said first contact portion projecting into the receptacle toward the opening generally parallel to the insertion direction.

13. The electrical connector of claim 12 wherein said second contact portion projects into the receptacle generally perpendicular to the insertion direction.

14. The electrical connector of claim 11 wherein said receptacle has an opening for receiving the plug portion of the mating connector in an insertion direction, said first contact portion projecting into the receptacle toward the opening generally parallel to the insertion direction.

15. The electrical connector of claim 11 wherein said contact arm includes a base section at a bottom of the receptacle, with said first contact portion projecting from the base section into the receptacle.

16. The electrical connector of claim 15 wherein said contact arm includes a flexible free section at an end of the base section, with said second contact portion projecting from a distal end of the free section into the receptacle.

17. The electrical connector of claim 11 wherein said contact arm includes a flexible section, with said second contact portion projecting from a distal end of the flexible section into the receptacle.

18. The electrical connector of claim 11 wherein said receptacle has an opening through which the plug portion of the mating connector is inserted into the receptacle, said contact arm of the terminal being generally U-shaped with a base section and a pair of side sections, said first and second contact portions being disposed on the base section and one of the side sections.

* * * * *